United States Patent [19]

Lawrimore

[11] 4,114,891

[45] Sep. 19, 1978

[54] HAZARDOUS TRAVEL SIMULATING GAME

[76] Inventor: William T. Lawrimore, P.O. Box 15, North Wilkesboro, N.C. 28659

[21] Appl. No.: 820,574

[22] Filed: Aug. 1, 1977

[51] Int. Cl.[2] ..... A63F 3/04

[52] U.S. Cl. ..... 273/250; 273/255; 273/290

[58] Field of Search ..... 273/243, 248, 249, 250, 273/251, 252, 253, 254, 255

[56] References Cited

U.S. PATENT DOCUMENTS

| | | | |
|---|---|---|---|
| 972,382 | 10/1910 | Johnson-Jervis | 273/255 |
| 2,268,433 | 12/1941 | Smith | 273/252 X |
| 3,075,772 | 1/1963 | Martino | 273/250 |
| 3,223,420 | 12/1965 | Turner | 273/256 X |
| 3,373,995 | 3/1968 | Fors | 273/250 |

FOREIGN PATENT DOCUMENTS

| | | | |
|---|---|---|---|
| 645,661 | 11/1950 | United Kingdom | 273/249 |
| 1,248,621 | 10/1971 | United Kingdom | 273/250 |

*Primary Examiner*—Anton O. Oechsle

[57] ABSTRACT

A game apparatus simulating interplanetary space travel includes: a planar playing board having a first circuitous path of player movement around the periphery of the playing board and a plurality of player landing sites or areas therealong representing various charted and identifiable locations and events which may occur along the way, and a second circuitous inner, chance determined alternate path of player movement intersecting said first path at a plurality of spaced points and having a plurality of player landing sites therealong representing events which may occur in unexplored and often hostile locations; a segmented, multi-purpose, chance instructional dial with a conventional spinner device randomly determines player movement or events which occur along the first and second paths of travel according to printed indicia within the individual segments of the dial. Instructions for further spaceship movement or player action are printed on each of the aforementioned player landing sites. In order to finish the game and win a participant must complete a voyage around the board and return to headquarters with his spaceship intact and operable.

3 Claims, 3 Drawing Figures

HAZARDOUS TRAVEL SIMULATING GAME

BACKGROUND OF THE INVENTION

Science fiction, space travel and interplanetary warfare are subjects which have long interested young and old alike. Books, movies and television have entertained and have spawned many space simulating game apparatuses and devices.

Some of the space related games played on a board simulating an interplanetary path of travel include those illustrated and described in U.S. Pat. Nos. 3,807,740, 3,973,775, and 3,985,361. There are also others in the related prior art, but the above listed patents are more recent and generally more pertinent to the present invention. Further, other travel simulated games such as those relating to airplanes, trains, covered wagons, horseback, autos, and the like may be equally interesting and appealing along the same general lines or concept.

SUMMARY OF THE PRESENT INVENTION

The present game apparatus is, as disclosed herein, described in terms of a simulated space voyage maintainance of fuel for the spacecraft, and events which may occur along the route for one or a plurality of players. According to the rules each participant commands an individual spacecraft and manipulates that craft around the board, which represents both explored and unexplored realms of outer space. During the trip which is controlled by a random chance indicator various perils, hostile forces, spacecraft problems, and the like may be encountered. The object of the game is to have one's spacecraft complete a roundtrip voyage through outer space, returning to headquarters command with the spacecraft intact and operable. At the beginning of the voyage each craft is given an alloted supply of fuel and supplies, a minimum of which must be maintained throughout the game. Therefore, participation in the game is as challenging for one participant as for several.

Spacecraft movement around the board is along one of two chance determined, circuitous, prescribed paths of travel. The first circuitous path extends around the outer perimeter of the game board and has a plurality of successive player landing points, each representing either a friendly base, a peril, problem, or entry point into the second path. Each of the landing points includes printed instructions for players to obey before continuing the space voyage.

A second circuitous path of travel is separately defined generally within the inner regions of the first path by a second plurality of successive player landing points representing the rigors and perils of travel in unexplored outer space. Each of these landing points also include instructions for participant's movement and activities along the voyage. During the course of a game a player may move into and out of each of the two paths many times, depending upon the events which occur during the course of play.

Initial movement at the outset of each player's turn is determined by a chance controlled device such as a dial and spinner. In a preferable embodiment, a dial is provided, which is divided into three separate and distinct annular fields of instruction, with each field further divided into segments containing player movement and instructions as to the results of war-like encounters. For example, the three fields or annular areas include a first ring in which each segment contains a number which determines the number of successive playing positions a spacecraft will move at the outset of a player's turn. A second, separate ring or field of instruction determines the results of the spacecraft's attack on an alien force or enemy ship. The third field of instruction defines damage inflicted as a result of attack by an alien force on a participant's craft and any defensive action which must be taken by the craft; i.e. repair the ship, retreat to allied territory, or continue journey with no significant damage to the craft. The spinner is activated by each player at the outset of his turn to randomly move the spinner to a resting spot over one of the segments in each ring.

The aforementioned two paths, which represent explored and unexplored realms of space, intersect at several points on the board. At these points of intersection a participant's craft may be directed to move out of one of the paths of travel into the other. Movement of players is determined from instructions printed on a given player landing point combined with the chance determined instructions on the dial. The dial instructional segments and instructions to be followed are, of course, determined by the stop of the pointer of a conventional spinning device as used in many chance contests.

The board design which incorporates dual paths of travel, and the multiplicity of chance instructions which indicate neutral, offensive and defensive activities to be performed by the players provide a challenging game for participation by one or more people of any age. Further, the challenge of the game will not become stale after repeated playing. The numerous combinations of moves and instructions insure that it will be a rare occurrence for a game to be duplicated.

While the above has been directed to a summarization of a preferred embodiment of the present game, it must be noted that the same general rules of play and the concept apply to other interest areas apart from space travel. For example, travel by early settlers of the west could be charted by paths leading through friendly territory and through a territory inhabited by hostiles. Wartime themes are applicable using combinations of allied and enemy territories. It is obvious that there are numerous other themes which could yield a challenging and entertaining venture for one person or several.

It is therefore an object of the present invention to provide a chance controlled game simulating extended travel through both friendly and unfriendly territories.

It is another object of the present invention to provide a game device having a combination of neutral, offensive and defensive participant activities determined completely by chance.

It is further an object of the present invention to provide a board game device simulating travel through friendly and unfriendly territories wherein one or more participants play against the board and occurrences determined thereon to complete a journey.

Still other and further objects of the invention will become obvious to those skilled in the art as the following detailed description is studied in conjunction with the accompanying drawings in which.

DETAILED DESCRIPTION OF A PREFERRED EMBODIMENT

As mentioned above, the game according to the present invention might be directed to numerous characterizations of travel wherein each participant is matched against the playing board to complete a journey through both friendly and hostile territories. For examplary purposes herein, the characterization will be that of a spacecraft attempting to safely complete a voyage through outer space.

Figure 1:
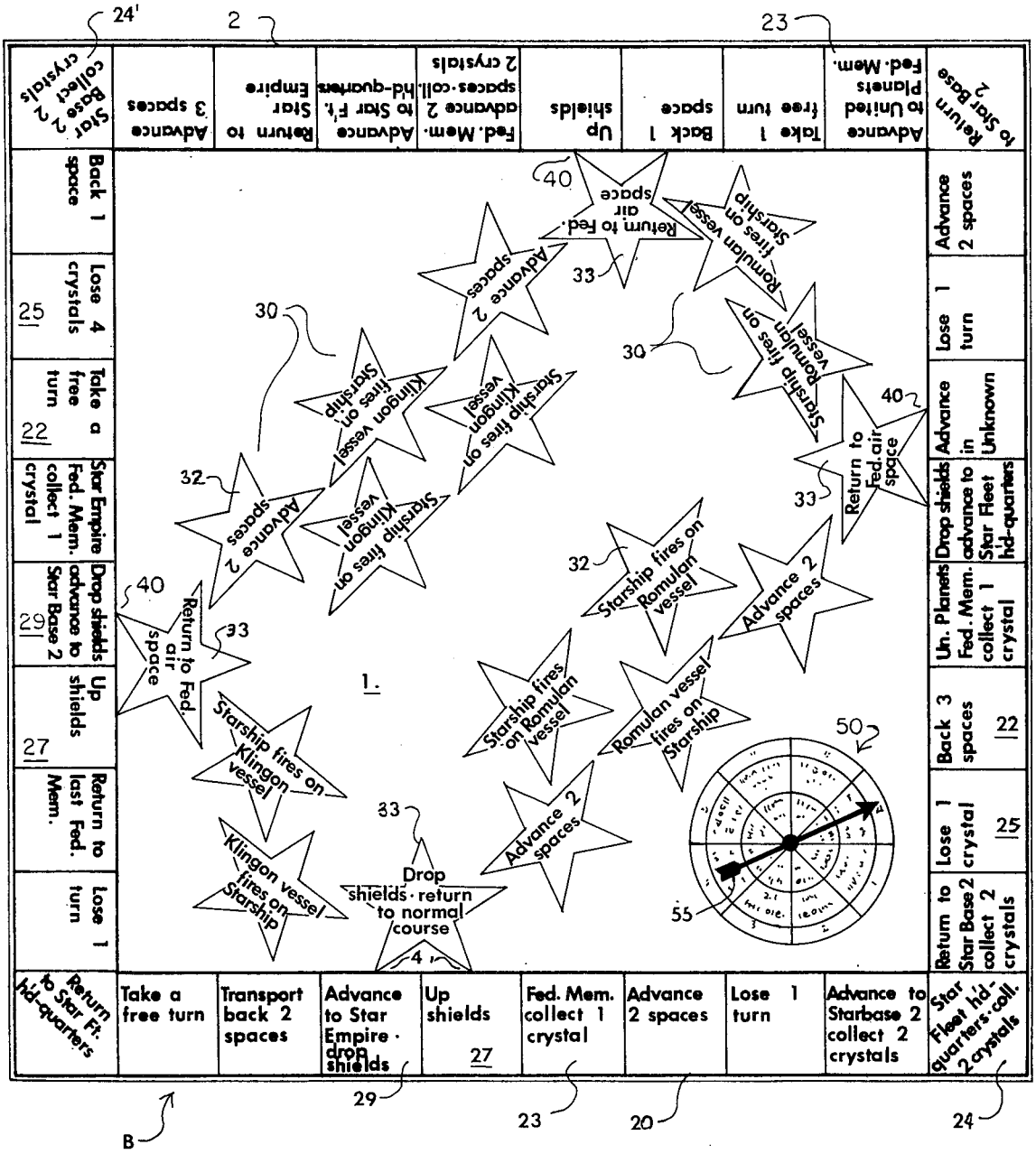
FIG. 1 is a plan view of the top of playing board according to the present invention.

Referring to FIG. 1, the playing board B has a planar top playing surface 10, generally of a square shape, and may be made from heavy cardboard or any other material which is known to be suitable for use in conventional game boards of this type. If desired the board B may be folded for storage.

A first path of travel 20 extends around the outer perimeter of the playing surface 10 and is representative of locations and occurrences which might be experienced while travelling in the explored and charted realm of outer space. It is along this path 20 that the spacecraft most safely travels. The path 20 includes a plurality of separate, successive player landing areas 22 emanating from starting point 24. In the illustrated embodiment the starting point 24 is indicated to represent headquarters command post. It is from this starting point 24 that the craft is launched and the craft must complete a roundtrip around the board ending at point 24 in order to win the game. Loss of the entire supply of fuel before returning to starting point 24 indicates destruction of the spacecraft and loss of the game. A second base or post is represented at 24' which is approximately half way around path 20. Some of areas 22 represent havens of safety and refueling, such as areas 23, some represent encounters with perils and adversaries, such as areas 25. All of areas 22 indicate directions for player movement, fuel gain or loss, or gains or losses of turns. Certain areas 27 indicate that a player must move into the second, more perilous path of travel 30 on his next turn.

The second path of travel 30 is defined in this embodiment by a second series of separate, successive, player landing sites 32, each of which is preferably indicated by a star-shaped area. All points in the second path 30 are positioned generally within the inner boundaries of first path 20. The path 30 and landing sites 32 are representative of encounters with hostile forces in an unexplored and frequently alien territory of outer space in which vital fuel supplies may be gained or lost quickly.

Movement into or out of one of the paths of travel 20 or 30 is by means of a plurality of contiguous points 40 where the two paths coincide. Certain areas 27 occur in path 20, which are immediately adjacent certain ones 33 of the player landing sites 32 in path 30. These selected sites 33 from path 30 point to two adjacent areas 27, 29. Players enter path 30 on the next turn after coming to rest on area 27 and leave path 30 into area 29 on the next turn after landing on area 33.

Progressive movement along either path 20 or 30, and landing on any of the areas in those paths is determined at the outset of a turn by chance according to instructions on the outer field 51 of dial 50 as defined by the stop of spinner 55 after it has been spun by a participant in turn. Device 50 is more clearly illustrated in FIG. 2.

Figure 2:
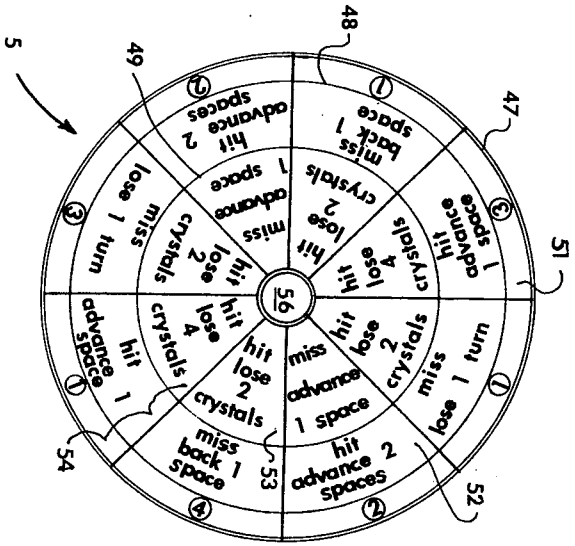
FIG. 2 is an enlarged view of the dial instructional device as seen in FIG. 1.

Looking at FIG. 2 it is apparent that dial 50 is divided into three annular fields or rings 51, 52, 53 of instruction delineated by adjacent concentric circles 47, 48, 49. Each of the annular fields is further divided into preferably eight instructional segments 54. The first field, ring 51, contains a numeral between one and four inclusive in each segment 54. This numeral represents the number of successive spaces or landing areas in path 20 or 30 which the spinning participant will move at the outset of his turn.

The second field of instruction, ring 52, includes instructions in each segment 54 as to the results occurring when a participant's craft fires on a hostile or alien force. For example, if participant's craft is proceeding along the second path of travel 30 and stops on a landing site 32 which indicates that the participant's craft fires on an enemy vessel, participant will spin the spinner 55, and follow the instructions provided in the appropriate segment 54 of field ring 52. Those instructions might read "direct hit, advance 2 spaces."

Third, inner, annular field of instruction on dial 50 reveals directions of play when a participant's craft is attacked by an enemy ship. For example, if participant is moving along path 30 and lands on a site 32 which states that a hostile force has fired on participant's vessel, spinner 55 would then be turned to randomly select an instructional segment 54 in ring 53. That segment might read "direct hit, lose fuel crystal."

Figure 3:
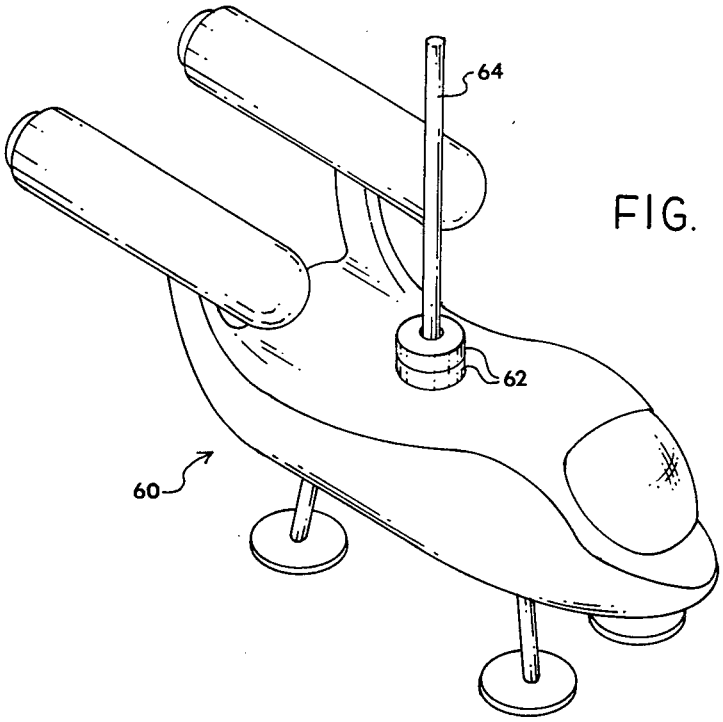
FIG. 3 is a perspective view of the preferred participant marker.

FIG. 3 is illustrative of a player piece which is manually movable about the playing board during the course of play. A plurality of fuel tokens 62 may be separately placed on and removed from a storage means such as a post 64 to indicate the amount of fuel, or other critical supply at any one time. Directions as to the addition or loss of such fuel tokens are determined by the directions on various landing sites 22, 40 and on the dial 50.

From the above explanation it is obvious that all moves made by a participant's space craft are randomly determined either directly or indirectly by a chance spin of the spinner 55. Therefore, game play is controlled by many combinations of instructions and would rarely be duplicated from one game to the next. Also, while the three fields 51, 52, and 53 are grouped on the same dial for the sake of minimizing space requirements on the board, it is apparent that the same results could be realized with three separate fields or dials.

Rules of play do not vary depending on the number of participants. They remain the same if one person is playing or several. Of course, movement is by turn or in succession if there are multiple participants.

A brief description of a game played by one person against the board might be as follows. Player places his spacecraft or rocket 60 (FIG. 3) on the playing surface 10 at starting point or "command headquarters" 24. The spinner 55 is placed on the center point 56 of dial 50. The first spin (assume a 3 is indicated) will determine from ring 51 that the craft 60 is to move along the first path 20 to the third landing site 22. Instructions at that site read "advance two spaces to check space violation." The craft then moves ahead two spaces on path 20 to what is the fifth site 22 from the starting point 24 which is one of the aforementioned points of intersection with inner path 30. The player is there instructed on his next turn to enter the "unknown" which is defined by second path of travel 30.

From that point, participant's craft will move along path 30 until receiving instructions to move back into the charted course or outer path 20. During play, participant will use instructions from the second and third fields 52, 53 of instruction as required (described above). Play will continue until the craft has dropped below minimum fuel to remain in travel and has therefore lost the game; or has successfully completed a roundtrip through space and returned to the starting/-finish point 24 to win the game, having defeated alien forces.

It will be obvious to those skilled in the art that various changes and modifications may be made without departing from the scope of the invention as claimed below.

What is claimed is:

1. A chance controlled game apparatus simulating travel through friendly, known territories and hostile, unknown territories, each having various perils, occurrences and events which determine the speed and success of the travel, said game apparatus comprising:

(A) a game board having a substantially planar upper playing surface, a plurality of player pieces manually movable along said playing surface, and a random selection means;

(B) said game board including:

(i) a first circuitous path of player movement delineated along the outer perimeter of said upper playing surface, said first path including a singular starting/finishing point and a plurality of individual, successive, player landing sites therealong having directions printed therein, anticipated occurrences which may alter the normal path of travel, routes, and supplies of critical materials;

(ii) a second circuitous path of player movement including a plurality of individual, successive, player landing sites therealong, each of said secondary landing sites having indicia printed thereon indicative of more unexpected occurrences which may alter the supply of the critical material necessary for continuance of the travel;

(iii) a selected plurality of spaced landing areas in said second path, each of which lies immediately adjacent one of a first group of sapced landing areas in said first path, movement of a player's piece into said second path being determined by the piece coming to rest on one of said first group of landing areas;

(iv) selected ones of the individual landing sites within said first and second paths forming a second group of landing sites including indicia thereon indicative of altered player piece movement along the prescribed paths of travel;

(v) selected others of the landing sites in said first path forming a third group of landing sites having indicia printed indicative of a gain or loss of said critical material for continuance of the simulated travel;

(vi) selected others of the landing sites in said second path forming a fourth group of landing sites having indicia printed thereon indicative of either an attack being launched by or against the player piece;

(C) said random selection means comprising a plurality of separate instructional fields:

(i) a first of said fields further divided into a plurality of instructional segments containing instructional indicia to regulate a prescribed number of areas a player piece moves along one of said first or second paths of movement;

(ii) a second of said fields divided into a plurality of instructional segments regulating the outcome in an attack launched by the player piece as a result of landing on one type of said fourth group of landing areas;

(iii) a third of said fields being divided into a plurality of instructional segments regulating the outcome of an attack launched against one of the player pieces as a result of landing on the other type of said fourth group of landing areas;

(iv) a random outcome means for randomly and simultaneously selecting one of said instructional segments in each of said first, second and third fields to be used during a turn of play in the game; wherein participants travel along a prescribed path of movement determined by instructional indicia on said individual landing sites combined with chance instructional indicia from prescribed ones of said fields randomly selected by said random outcome means.

2. The game apparatus according to claim 1 wherein said first, second, and third instructional fields are combined on the same dial face with each field comprising an annular ring of differing diametrical dimensions whereby the three fields form concentric areas thereon.

3. The game apparatus according to claim 1 wherein each of said player pieces includes a storage means associated therewith, and a plurality of fuel tokens manually placed in and removed from said storage means.

* * * * *